US009309649B2

(12) United States Patent
Nishikawa et al.

(10) Patent No.: US 9,309,649 B2
(45) Date of Patent: Apr. 12, 2016

(54) WORK MACHINE

(75) Inventors: Hiroyasu Nishikawa, Tokyo (JP); Sei Shimahara, Tokyo (JP); Manabu Nakanishi, Kobe (JP); Masashi Shibata, Kobe (JP)

(73) Assignee: Caterpillar SARL, Geneva (CH)

( * ) Notice: Subject to any disclaimer, the term of this patent is extended or adjusted under 35 U.S.C. 154(b) by 350 days.

(21) Appl. No.: 13/255,656

(22) PCT Filed: Feb. 2, 2010

(86) PCT No.: PCT/JP2010/051372

§ 371 (c)(1),
(2), (4) Date: Sep. 9, 2011

(87) PCT Pub. No.: WO2010/103878

PCT Pub. Date: Sep. 16, 2010

(65) Prior Publication Data

US 2011/0315415 A1 Dec. 29, 2011

(30) Foreign Application Priority Data

Mar. 12, 2009 (JP) ..... 2009-059481

(51) Int. Cl.
*B25D 9/00* (2006.01)
*E21B 7/02* (2006.01)
(Continued)

(52) U.S. Cl.
CPC ..... *E02F 9/2296* (2013.01); *E02F 3/966* (2013.01); *E02F 9/2228* (2013.01); *E02F 9/2285* (2013.01); *E02F 9/2292* (2013.01)

(58) Field of Classification Search
CPC ..... F15B 2211/6313; F15B 2211/6309; F15B 2211/329; F15B 2211/6653; F15B 11/166; F15B 2211/575; F15B 15/2815–15/2892; E02F 3/966; E02F 3/3604; E02F 9/128; B28D 1/26
USPC ..... 173/200, 28, 90, 177, 189
See application file for complete search history.

(56) References Cited

U.S. PATENT DOCUMENTS 4,072,354 A * 2/1978 Holmes ..... 299/37.4
5,000,650 A * 3/1991 Brewer et al. ..... 414/699
(Continued)

FOREIGN PATENT DOCUMENTS

DE 3523219 C1 6/1986
JP S5238101 U 3/1977
(Continued)

OTHER PUBLICATIONS

Extended European Search Report EP Application No. 10750634.7 dated Nov. 27, 2014.

*Primary Examiner* — Stephen F Gerrity
*Assistant Examiner* — Eyamindae Jallow

(57) ABSTRACT

A work machine equipped with an automatic hammering function is capable of preventing breakage of the hammer caused by blank firing. Hydraulic oil fed to a hydraulic breaker at the distal end of a work machine is controlled by first and second spools. Operating an operation lever so as to contract single rod type boom cylinders to press the hydraulic breaker against an object to be crushed. Head-side pressure and rod-side pressure of the boom cylinders are respectively detected by pressure sensors. Any one of switches is used to switch the mode of automatic hammering operation between an automatic hammering inhibiting mode and an automatic hammering authorizing mode. In the automatic hammering authorizing mode, a controller controls the first and second spools of the hydraulic breaker so as to open them only when head-side pressure and rod-side pressure of the boom cylinders are in a given range of pressing force.

6 Claims, 11 Drawing Sheets

(51) Int. Cl.

| | |
|---|---|
| ***E21B 1/00*** | (2006.01) |
| ***E02F 9/22*** | (2006.01) |
| ***E02F 3/96*** | (2006.01) |

(56) References Cited

U.S. PATENT DOCUMENTS

| | | | | |
|---|---|---|---|---|
| 5,148,676 | A * | 9/1992 | Moriya et al. | 60/429 |
| 5,218,820 | A * | 6/1993 | Sepehri et al. | 60/463 |
| 5,313,871 | A * | 5/1994 | Kaneko et al. | 91/361 |
| 5,325,063 | A * | 6/1994 | Morgan | 324/636 |
| 5,332,047 | A * | 7/1994 | Hignite | 173/1 |
| 5,361,070 | A * | 11/1994 | McEwan | 342/21 |
| 5,375,664 | A * | 12/1994 | McDowell et al. | 173/1 |
| 5,455,769 | A * | 10/1995 | Panoushek et al. | 701/50 |
| 5,692,376 | A * | 12/1997 | Miki et al. | 60/328 |
| 6,142,059 | A * | 11/2000 | Chan et al. | 92/5 R |
| 6,286,412 | B1 * | 9/2001 | Manring et al. | 91/433 |
| 6,542,789 | B2 * | 4/2003 | Ufheil | 700/275 |
| 6,615,581 | B2 * | 9/2003 | Kusuyama | 60/328 |
| 6,715,402 | B2 * | 4/2004 | Pfaff et al. | 91/526 |
| 6,725,131 | B2 * | 4/2004 | Lunzman | 700/282 |
| 6,761,029 | B2 * | 7/2004 | Linerode | 60/459 |
| 6,789,458 | B2 * | 9/2004 | Schumacher et al. | 91/363 R |
| 7,099,722 | B2 * | 8/2006 | Casey | 700/85 |
| 7,111,691 | B2 * | 9/2006 | Siltanen et al. | 173/200 |
| 7,178,333 | B2 * | 2/2007 | Oka | 60/421 |
| 7,441,404 | B2 * | 10/2008 | Devier et al. | 60/368 |
| 7,478,530 | B2 * | 1/2009 | Ueda | 60/399 |
| 7,478,648 | B2 * | 1/2009 | Lundgren | 138/31 |
| 7,640,998 | B2 * | 1/2010 | Howell, Jr. | 173/184 |
| 8,095,281 | B2 * | 1/2012 | Peterson et al. | 701/50 |
| 8,387,289 | B2 * | 3/2013 | Hanakawa et al. | 37/348 |
| 8,438,843 | B2 * | 5/2013 | Ueda et al. | 60/328 |
| 8,631,650 | B2 * | 1/2014 | Verkuilen et al. | 60/422 |
| 8,704,507 | B2 * | 4/2014 | Oksman et al. | 324/76.11 |
| 2003/0121184 | A1 * | 7/2003 | Yoshino et al. | 37/348 |
| 2003/0145721 | A1 * | 8/2003 | Oka et al. | 91/444 |
| 2004/0031173 | A1 * | 2/2004 | Yoshino et al. | 37/348 |
| 2004/0045727 | A1 | 3/2004 | Allums et al. | |
| 2004/0055288 | A1 * | 3/2004 | Pfaff et al. | 60/422 |
| 2004/0055289 | A1 * | 3/2004 | Pfaff et al. | 60/422 |
| 2004/0055452 | A1 * | 3/2004 | Tabor | 91/433 |
| 2007/0059146 | A1 * | 3/2007 | Bitter | 414/685 |
| 2007/0068707 | A1 * | 3/2007 | Henriksson et al. | 175/417 |
| 2007/0095059 | A1 * | 5/2007 | VerKuilen et al. | 60/468 |
| 2007/0130935 | A1 * | 6/2007 | Stephenson et al. | 60/484 |
| 2007/0186451 | A1 * | 8/2007 | Yoshimatsu | 37/348 |
| 2008/0110165 | A1 * | 5/2008 | Hamkins et al. | 60/414 |
| 2008/0110166 | A1 * | 5/2008 | Stephenson et al. | 60/414 |
| 2008/0217037 | A1 * | 9/2008 | Howell | 173/28 |
| 2010/0043418 | A1 * | 2/2010 | Verkuilen et al. | 60/327 |
| 2010/0139939 | A1 * | 6/2010 | Kim | 173/115 |
| 2010/0288098 | A1 * | 11/2010 | Matsuura | 83/830 |
| 2011/0072809 | A1 * | 3/2011 | Verkuilen et al. | 60/327 |
| 2011/0202232 | A1 * | 8/2011 | Busch et al. | 701/36 |
| 2011/0308242 | A1 * | 12/2011 | Pfaff et al. | 60/327 |
| 2012/0145424 | A1 * | 6/2012 | Nickels et al. | 173/90 |
| 2012/0216517 | A1 * | 8/2012 | Peterson et al. | 60/327 |
| 2012/0216518 | A1 * | 8/2012 | Peterson et al. | 60/327 |
| 2012/0216519 | A1 * | 8/2012 | Peterson et al. | 60/327 |
| 2012/0221212 | A1 * | 8/2012 | Peterson et al. | 701/50 |
| 2013/0081837 | A1 * | 4/2013 | Jagdale et al. | 173/90 |
| 2013/0098013 | A1 * | 4/2013 | Edler et al. | 60/327 |
| 2013/0098014 | A1 * | 4/2013 | Kuehn et al. | 60/327 |
| 2013/0129460 | A1 * | 5/2013 | Gabibulayev | 414/699 |
| 2013/0283777 | A1 * | 10/2013 | Wen et al. | 60/477 |
| 2013/0330160 | A1 * | 12/2013 | Oka | 414/687 |

FOREIGN PATENT DOCUMENTS

| | | | |
|---|---|---|---|
| JP | S641878 | U | 1/1989 |
| JP | 5-185378 | A | 7/1993 |
| JP | 2002-115274 | A | 4/2002 |
| JP | 2004-82257 | A | 3/2004 |
| WO | 2006/129399 | A1 | 12/2006 |

* cited by examiner

WORK MACHINE

CROSS REFERENCE TO PRIOR APPLICATIONS

This application is a U.S. National Phase application under 35 U.S.C. §371 of International Application No. PCT/JP2010/051372, filed on Feb. 2, 2010 and claims benefit of priority to Japanese Patent Application No. 2009-059481, filed on Mar. 12, 2009. The International Application was published in Japanese on Sep. 16, 2010 as WO 2010/103878 A1 under PCT Article 21(2). All of these applications are herein incorporated by reference.

TECHNICAL FIELD

The present invention relates to a work machine that is capable of automatically driving a hydraulic breaker thereof.

BACKGROUND

A hydraulic work machine is equipped with a hydraulic breaker attached to the distal end of a work equipment that is mounted on the machine body in such a manner as to be capable of moving vertically. The hydraulic breaker is provided with a hydraulic hammer mechanism that does not require flow rate adjusting operation at the machine body (e.g. see Japanese Laid-open Patent Publication No. 5-185378 (p 1, and FIG. 1)).

The operation procedure for crushing an object to be crushed by means of a hammer of a hydraulic breaker of this type includes steps in the order of first positioning the distal end of the hammer on the object to be crushed; subsequently raising the machine body relative to the hammer by operating the lever that serves to vertically move the boom of the work equipment so as to lower the boom and press the hammer against the object to be crushed; then, by operating a switch or other similar element, starting striking operation of the hammer while applying the load of the machine body to the object to be crushed through the end of the hammer; and, when the object is crushed, returning the switch or other similar element to the neutral position, thereby completing the striking operation.

At that time, it is necessary to operate the switch or other similar element while adjusting the load applied to the object to be crushed during a boom-down operation. This operation not only requires the operator to have sophisticated skills, but also causes the operator to become greatly fatigued.

To be more specific, as striking in the state where no load is applied to the hammer causes blank firing, which results in damage to the hammer, it is necessary to finish striking immediately when the object to be crushed is demolished. Even a skilled operator, however, is prone to a slight delay in actually shifting the switch or other similar element to the neutral position after the object is demolished and thereby causing a blank firing.

In order to solve the above problems, an object of the invention is to provide a work machine equipped with an automatic hammering function that is easy to operate and capable of preventing breakage of the hammer caused by blank firing.

SUMMARY

The present example relates to a work machine that includes a machine body, a work equipment, a hydraulic breaker, a control valve, a single rod type hydraulic cylinder, an operation unit, pressure sensors, a changeover switch, and a controller. The work equipment is mounted on the machine body. The hydraulic breaker is attached to the distal end of the work equipment. The control valve is adapted to control hydraulic oil fed to the hydraulic breaker. The hydraulic cylinder is adapted to operate the work equipment downward so that the hydraulic breaker is pressed against an object to be crushed. The operation unit is adapted to operate the hydraulic cylinder in a contracting direction so that the work equipment is operated downward. The pressure sensors respectively serve to detect pressure at the head side and pressure at the rod side of the hydraulic cylinder. The changeover switch is capable of switching the hydraulic breaker between an automatic hammering inhibiting mode, in which operation of the hydraulic breaker is inhibited, and an automatic hammering authorizing mode, in which operation of the hydraulic breaker is permitted. The controller has a function of controlling the control valve of the hydraulic breaker so that the control valve opens only when pressure at the head side and pressure at the rod side of the hydraulic cylinder respectively detected by the pressure sensors are in a given range of pressing force, while the hydraulic breaker is in the automatic hammering authorizing mode as a result of switching operation of the changeover switch.

The controller of the work machine can have such a function that the controller returns to the automatic hammering inhibiting mode should the changeover switch be turned on once and left without further operation for a given period of time thereafter and that the controller is set to the automatic hammering authorizing mode should the changeover switch be turned on again within the given period of time.

Another example can be provided with a monitor adapted to display at least that the work machine is in the automatic hammering authorizing mode.

A further example of the controller of the work machine can be adapted to be set to the automatic hammering inhibiting mode should the changeover switch be turned on while in the automatic hammering authorizing mode.

Another controller of the work machine may have such a function that, when the head-side pressure and the rod-side pressure of the hydraulic cylinder become less than the given range of pressing force from the given range of pressing force, reactivation of the hydraulic breaker requires a reset operation performed by returning the operation unit, which is adapted to operate the work equipment downward, to a neutral position first and subsequently operating the operation unit again in such a direction as to lower the work equipment.

The controller of the work machine according to a present example has a switching device that switches between a function that, when the head-side pressure and the rod-side pressure of the hydraulic cylinder become less than the given range of pressing force from the given range of pressing force, reactivation of the hydraulic breaker requires a reset operation performed by returning the operation unit, which is adapted to operate the work equipment downward, to a neutral position first and subsequently operating the operation unit again in such a direction as to lower the work equipment, and a function that, after the head-side pressure and the rod-side pressure of the hydraulic cylinder become less than the given range of pressing force from the given range of pressing force, reactivation of the hydraulic breaker requires recovering the head-side pressure and the rod-side pressure of the hydraulic cylinder to the given range of pressing force without the aforementioned reset operation.

The controller controls the control valve of the hydraulic breaker so that the control valve opens only when pressure at the head side and pressure at the rod side of the hydraulic cylinder respectively detected by the pressure sensors are in a given range of pressing force, while the hydraulic cylinder is operating the work equipment downward and the controller is in the automatic hammering authorizing mode as a result of switching operation of the changeover switch. Therefore, after the controller is switched to the automatic hammering authorizing mode by means of the changeover switch, in order to activate automatic operation of the hydraulic breaker while ensuring a sufficient level of pressing force, the operator is required only to operate the operation unit in such a direction as to lower the work equipment and does not need to operate the switch to operate or stop the hydraulic breaker. In other words, the present invention provides an automatic hammering function that is not only simple to operate but also capable of preventing damage to the hammer that would otherwise be caused by blank firing.

Further, turning on the changeover switch twice in a given period of time sets the controller to the automatic hammering authorizing mode. Should the given period of time has elapsed after the changeover switch is turned on only once, the controller automatically returns to the automatic hammering inhibiting mode. Therefore, erroneous activation by inadvertently operating on the changeover switch once can be prevented.

In an additional example, the monitor displays that the work machine is in the automatic hammering authorizing mode, in which operation of the hydraulic breaker is permitted. Therefore, an undesired striking due to an inadvertent operation by the operator is prevented.

Additionally, turning on the changeover switch while in the automatic hammering authorizing mode sets the controller to the automatic hammering inhibiting mode. Therefore, when raising the machine body to change the direction or for other reasons, the automatic hammering mode can easily be switched to the automatic hammering inhibiting mode.

In yet another example, when the hydraulic breaker becomes less than the given range of pressing force from the given range of pressing force, reactivation of the hydraulic breaker requires a reset operation that is performed by temporarily returning the operation unit of the work equipment to the neutral position and subsequently operating the operation unit again in such a direction as to lower the work equipment. Therefore, the hydraulic breaker is prevented from performing any striking that is not anticipated by the operator. Accordingly, the aforementioned reset operation can be eliminated by switching with a switching device.

BRIEF DESCRIPTION OF DRAWINGS

FIG. 5(*b*) is a front view of the operation lever; and FIG. 5(*c*) is a schematic illustration of a switching pattern of automatic hammering modes by means of switches of the operation lever.

DESCRIPTION OF THE INVENTION

Next, the present invention is explained in detail hereunder, referring to examples thereof shown in FIGS. 1 to 11.

Figure 3:
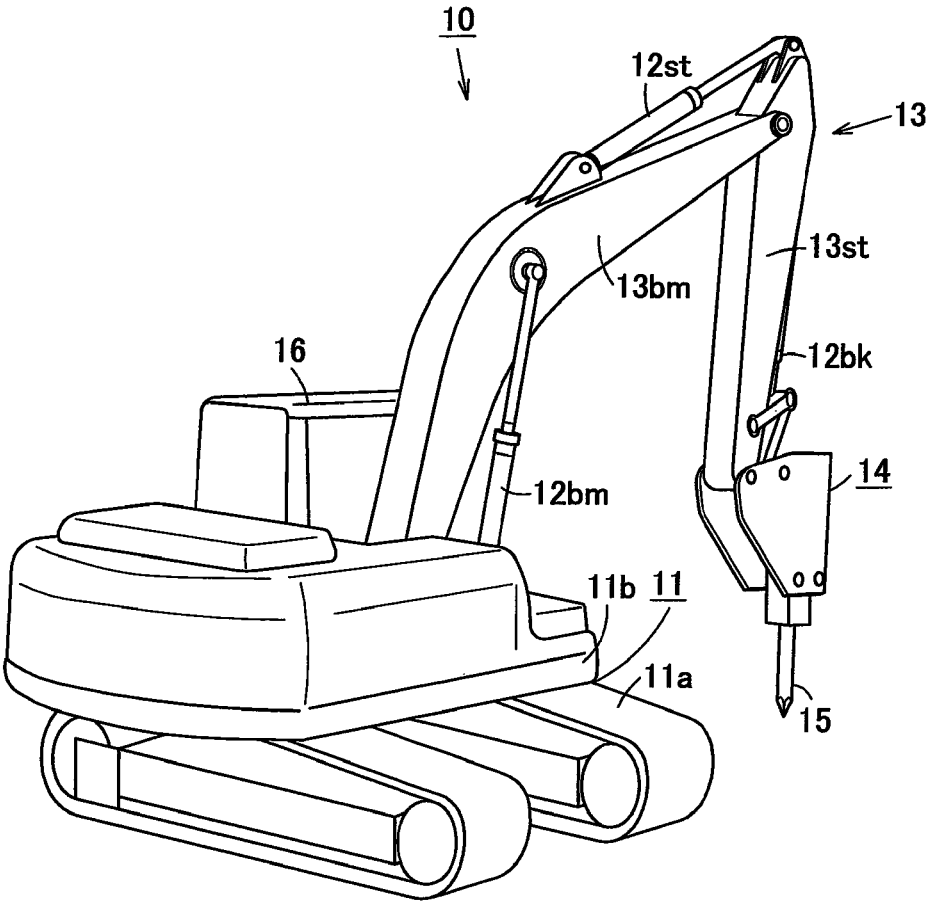
FIG. 3 is a perspective view of the work machine.

FIG. 3 illustrates a hydraulic excavator type work machine 10, of which a machine body 11 has a lower structure 11*a* and an upper structure 11*b*. The upper structure 11*b* is rotatably mounted on the lower structure 11*a*. A work equipment 13 is mounted on the machine body 11 and adapted to be moved up and down by means of boom cylinders 12*bm*, which are hydraulic cylinders. A hydraulic breaker 14 provided with a hydraulically actuated hammer device 15 is attached to the distal end of the work equipment 13.

The work equipment 13 includes a boom 13*bm* and a stick 13*st*. The base end of the boom 13*bm* is supported on the lower structure 11*a* by a shaft so that the boom 13*bm* is capable of pivoting vertically. The base end of the stick 13*st* is pivotally supported at the distal end of the boom 13*bm* by a shaft. The aforementioned hydraulic breaker 14 is pivotally supported at the distal end of the stick 13*st* by a shaft. The boom 13*bm*, the stick 13*st*, and the hydraulic breaker 14 are adapted to be pivoted by the boom cylinders 12*bm*, a stick cylinder 12*st*, and a bucket cylinder 12*bk*, respectively.

A cab 16 for protecting the operator's workspace is mounted on the upper structure 11*b*, at one lateral side thereof.

Figure 4:
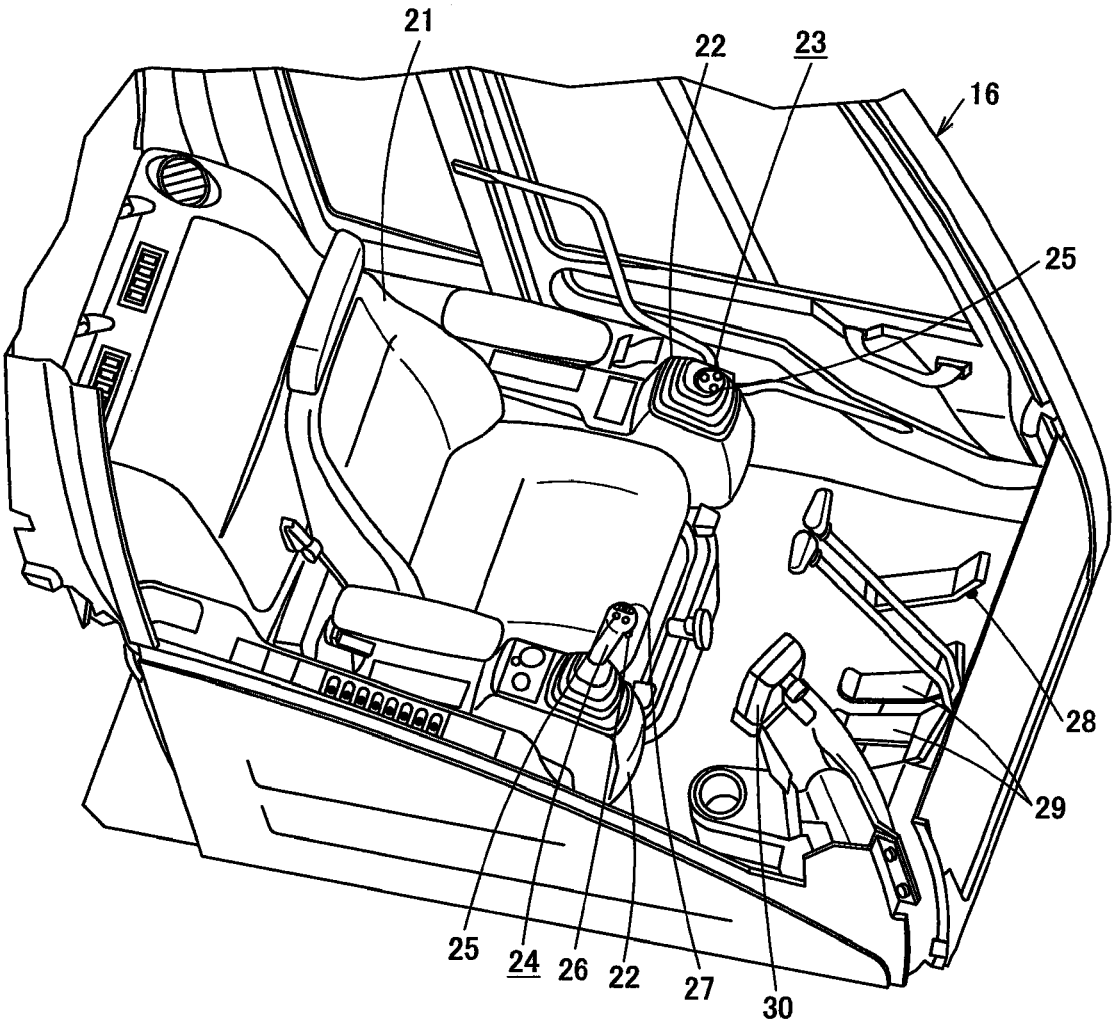
FIG. 4 is a perspective view of the interior of the cab of the work machine.

FIG. 4 illustrates the interior of the cab 16, in which a console 22 is provided at each lateral side of an operator's seat 21. An operation lever 23,24 serving as an operation unit is provided on the upper part of each console 22. Of the two operation levers 23,24, the operation lever 24 serves to operate the boom 13*bm*. Provided on the operation lever 24 are pushbutton switches 25,26, which serve as changeover switches, and a thumbwheel switch 27, which, too, serves as a changeover switch. Furthermore, a foot-operated switch 28, which, too, serves as a changeover switch, is provided at one side of a travel operation pedal 29, and a monitor 30 is provided at the other side of the travel operation pedal 29.

Figure 5:
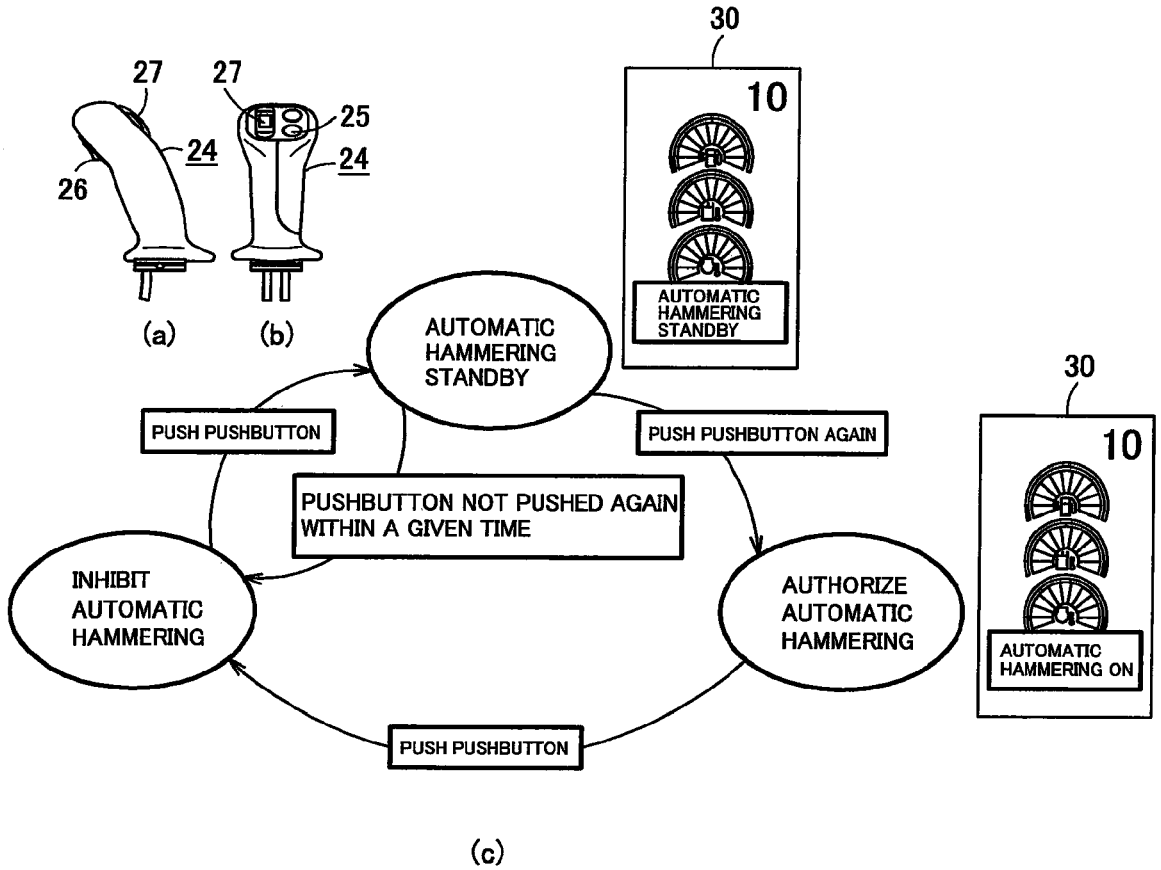
FIG. 5(*a*) is a side view of an example of an operation lever of the work machine.

FIGS. 5(*a*) and (*b*) illustrate the operation lever 24 at one side. The pushbutton switch 25 and the thumbwheel switch 27 are provided on the front face of the upper part of the operation lever 24, and the pushbutton switch 26 is provided on the rear face of the upper part of the operation lever 24. Any one of these switches 25,26,27 is used as a changeover switch for switching automatic hammering modes when automatically driving the hammer device 15 of the hydraulic breaker 14.

FIG. 5(*c*) illustrates a switching pattern of automatic hammering modes. In order to prevent inadvertent striking, an automatic hammering inhibiting mode serves as the default mode. By turning on any one of the switches 25,26,27, which are pushbuttons or another type of switch, while in the aforementioned automatic hammering inhibiting mode, the system is switched to an automatic hammering standby mode. By turning on any one of the switches 25,26,27 within a given period of time while in the automatic hammering standby mode, the system is switched to an automatic hammering authorizing mode. By turning on any one of the switches 25,26,27 while in the automatic hammering authorizing mode, the system returns to the automatic hammering inhibiting mode.

In cases where none of the switches 25,26,27, which are pushbuttons or another type of switch, is turned on within the given period of time while in the automatic hammering standby mode, the system returns to the automatic hammering inhibiting mode. When the system is in the automatic hammering standby mode, the words "Automatic hammering: Standby" are displayed on the monitor 30, and when the system is in the automatic hammering authorizing mode, the words "Automatic hammering: ON" are displayed on the monitor 30.

Figure 1:
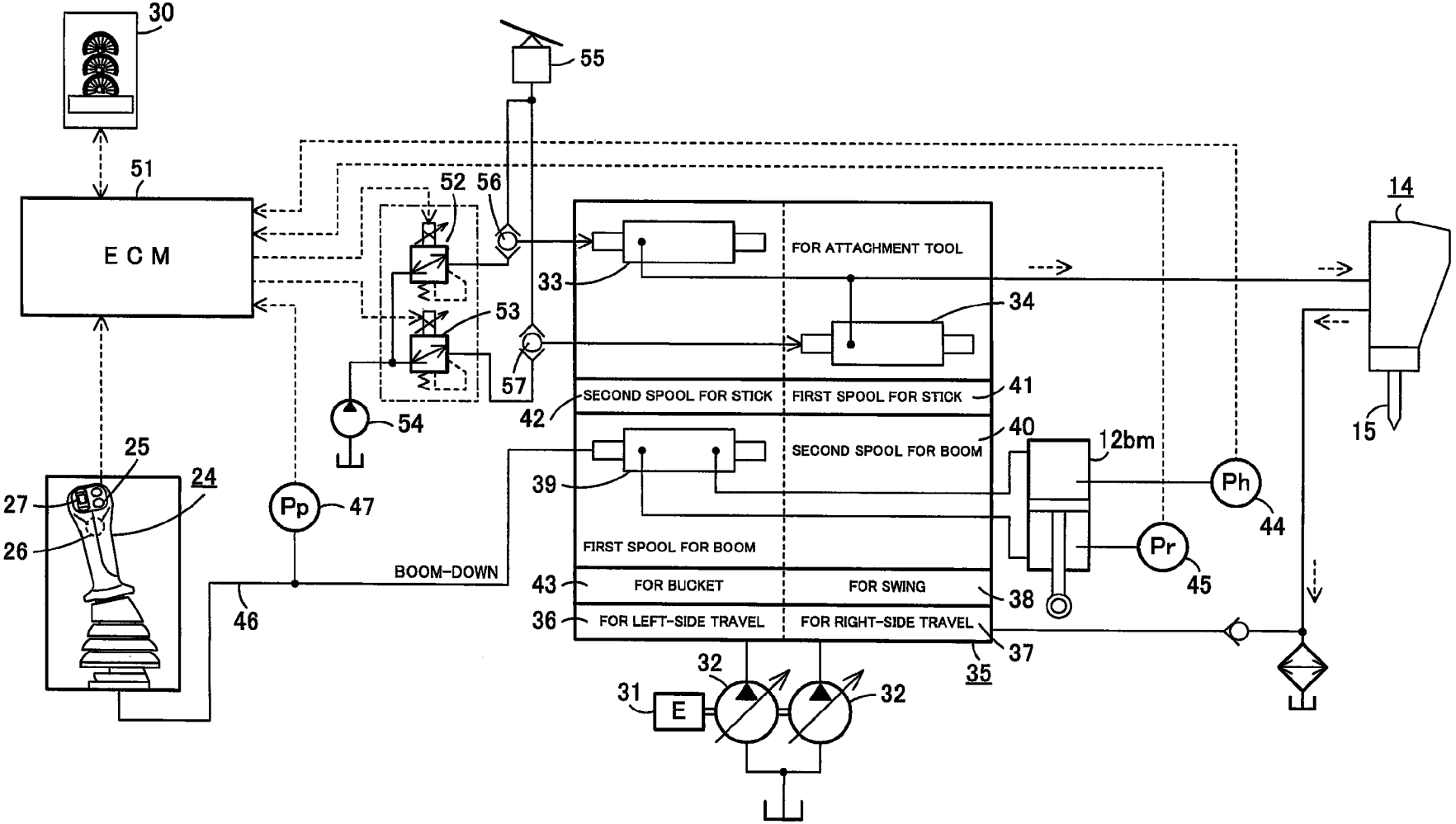
FIG. 1 is a schematic diagram showing an example of a control circuit for controlling a hydraulic breaker of a work machine according to the present invention.

FIG. 1 provides a schematic illustration of a control circuit for controlling the hydraulic breaker 14. In the control circuit, an attachment tool controlling first spool 33 and an attachment tool controlling second spool 34 are movably provided in a control valve block 35. The attachment tool controlling first and second spools 33,34 together serve as a control valve for controlling hydraulic oil fed to the hydraulic breaker 14 from main pumps 32, which are driven by an on-vehicle engine 31.

Provided in the control valve block 35 are a left-side traveling motor controlling spool 36, a right-side traveling motor controlling spool 37, a swing motor controlling spool 38, a boom cylinder controlling first spool 39, a boom cylinder controlling second spool 40, a stick cylinder controlling first spool 41, a stick cylinder controlling second spool 42, and a bucket cylinder controlling spool 43. All of these spools 36 to 43 are pilot operated and can be moved easily.

The boom cylinders 12*bm* are single rod type hydraulic cylinders adapted to press the hydraulic breaker 14 against an object to be crushed by operating the work equipment 13 downward. The operation lever 24 serves as an operation unit that is adapted to extend the boom cylinders 12*bm*, thereby raising the work equipment 13, and contract the boom cylinders 12*bm*, thereby lowering the work equipment 13. The operation lever 24 incorporates a pressure reduction valve, i.e. a valve commonly called a remote control valve, that serves to output pilot pressure for controlling spool movement.

The boom cylinders 12*bm* are provided at the head side thereof with a pressure sensor 44 for detecting pressure at the head side, i.e. boom-head pressure Ph. Provided at the rod side of the boom cylinders 12*bm* is a pressure sensor 45 for detecting pressure at the rod side, i.e. boom-rod pressure Pr. Furthermore, a boom-down pilot line 46 is drawn from the remote control valve of the operation lever and communicates with a boom-down pilot pressure receiving portion of the boom cylinder controlling first spool 39. The boom-down pilot line 46 is provided with a pressure sensor 47 for detecting boom-down pilot pressure Pp, which is pilot pressure output from the remote control valve of the operation lever 24 in order to lower the boom.

The operation lever 24 is provided with changeover switches that are capable of switching the modes of the hydraulic breaker 14 between the automatic hammering inhibiting mode, in which operation of the hydraulic breaker 14 is inhibited, and the automatic hammering authorizing mode, in which operation of the hydraulic breaker 14 is permitted. The changeover switches of the operation lever 24 consist of the pushbutton switches 25,26, which are respectively provided on the front face and the rear face of the operation lever 24, and the thumbwheel switch 27. Each one of these switches 25,26,27 can be used as a changeover switch for operating the hydraulic breaker 14.

As illustrated in FIG. 1, the pressure sensor 44 for boom-head pressure Ph, the pressure sensor 45 for boom-rod pressure Pr, and the pressure sensor 47 for boom-down pilot pressure Pp are connected to an input section of a controller 51, which is an electronic control module (ECM). An output section of the controller 51 is connected to solenoids of solenoid-operated directional control valves 52,53.

Pilot primary pressure is fed from a pilot pump 54. The aforementioned solenoid-operated directional control valves 52,53 are pressure reduction valves for transforming the pilot primary pressure to pilot secondary pressure that is based on a control signal from the controller 51. The pilot secondary pressure is applied to the pilot pressure receiving portions of the tool attachment controlling first and second spools 33,34 for controlling the hammer device 15 of the hydraulic breaker 14.

The controller 51 has a function of controlling the tool attachment controlling first and second spools 33,34 through the solenoid-operated directional control valves 52,53 so that the tool attachment controlling first and second spools 33,34 open only when the machine body 11 is in the raised state, in other words when the boom-head pressure Ph and the boom-rod pressure Pr of the boom cylinders 12*bm* respectively detected by the pressure sensors 44,45 are in a given range of pressing force, provided that the automatic hammering authorizing mode is ON as a result of switching operation by one of the switches 25,26,27 and that the boom-down pilot pressure Pp detected by the pressure sensor 47 is higher than a set pressure.

The tool attachment controlling first and second spools 33,34 for controlling the hydraulic breaker 14 can be pilot operated by means of pilot pressure fed through shuttle valves 56,57 from a pedal-operated remote control valve 55.

As illustrated in FIG. 5(*c*), the controller 51 is adapted to return to the automatic hammering inhibiting mode should the given period of time elapses without any switch being operated after one of the switches 25,26,27 is turned on. The controller 51 is also adapted to be set to the automatic hammering authorizing mode should one of the switches 25,26,27 be turned on again within the aforementioned given period of time.

Furthermore, the controller 51 is also adapted to be set to the automatic hammering inhibiting mode by turning on one of the switches 25,26,27 while in the automatic hammering authorizing mode.

The controller 51 has such a function that, when the machine body 11 is no longer in the raised position, in other words when the boom-head pressure Ph and the boom-rod pressure Pr of the boom cylinders 12*bm* are not in the aforementioned given range of pressing force (in other words, when the boom-head pressure Ph and the boom-rod pressure Pr of the boom cylinders 12*bm* become less than the given range of pressing force from the given range of pressing force), reactivation of the hydraulic breaker 14 requires a reset operation performed by returning the operation lever 24 to the neutral position first and then operating the operation lever 24 in such a direction as to lower the work equipment 13.

Figure 2:
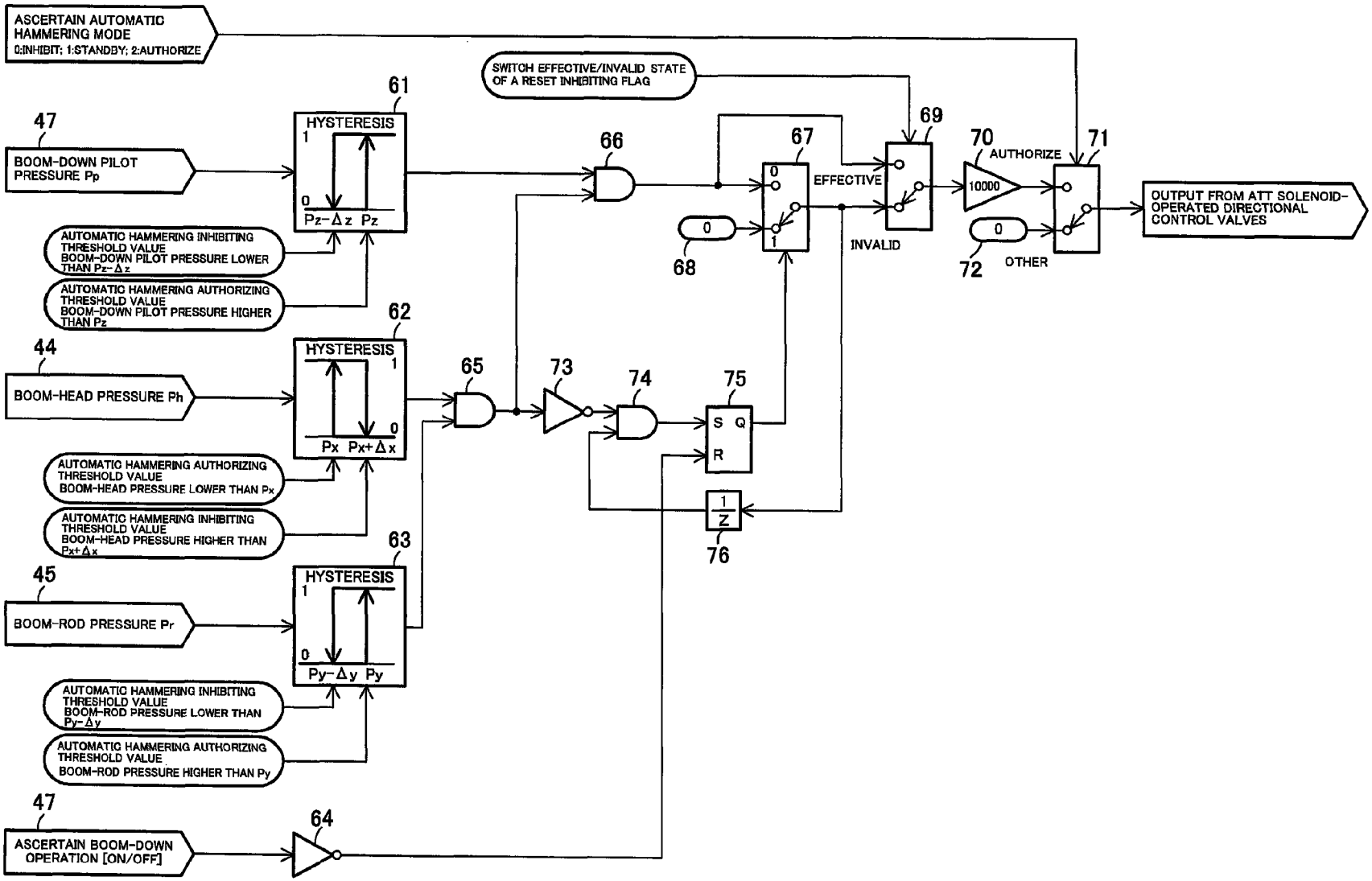
FIG. 2 is a logic circuit diagram showing a control logic in a controller of the control circuit.

FIG. 2 illustrates a control logic circuit in the controller 51. The boom-down pilot pressure Pp detected by the pressure sensor 47 is input into a hysteresis characteristic section 61 that has an automatic hammering authorizing threshold value Pz and an automatic hammering inhibiting threshold value Pz−Δz. The boom-head pressure Ph detected by the pressure sensor 44 is input into a hysteresis characteristic section 62 that has an automatic hammering authorizing threshold value Px and an automatic hammering inhibiting threshold value Px+Δx. The boom-rod pressure Pr detected by the pressure sensor 45 is input into a hysteresis characteristic section 63 that has an automatic hammering authorizing threshold value Py and an automatic hammering inhibiting threshold value Py−Δy. The boom-down ascertaining signal (ON/OFF) detected by the pressure sensor 47 is input into a NOT 64.

Output sections of the hysteresis characteristic sections 62,63 are connected to an input section of an AND 65. An output section of the hysteresis characteristic section 61 and an output section of the AND 65 are connected to an input section of an AND 66. An output section of the AND 66 is connected to a 0-side of a switching device 67. A 0 input section 68 is connected to a 1-side of the switching device 67. The output section of the AND 66 is also connected to an effective side of a switching device 69 for switching a reset inhibiting flag between an effective state and an invalid state. An output section of the switching device 67 is connected to an invalid side of the switching device 69. An output section of the switching device 69 is connected through a buffer 70 to an authorizing side of a switching device 71, which is adapted to be switched based on ascertainment of authorization of automatic hammering, in other words between authorization and inhibition/standby. A 0 input section 72 is connected to an inhibiting/standby-side of the switching device 71. An output section of the switching device 71 is connected to the solenoids of the solenoid-operated directional control valves 52,53 illustrated in FIG. 1.

The output section of the AND 65 is also connected through a NOT 73 to one of the input sections of an AND 74. An output section of the AND 74 is connected to a set signal input section S of an RS flip-flop 75. An output section of the NOT 64 is connected to a reset signal input section R of the RS flip-flop 75. An output section Q of the RS flip-flop 75 is connected to a switching signal input section of the switching device 67. An output section of the switching device 67 is connected to the other input section of the AND 74 through a previous value application section 76 for applying a previous value.

The AND 65 serves to ascertain pressure conditions of the boom cylinders 12*bm*. In order to activate hammering operation, it is necessary to press the hammer device 15 of the hydraulic breaker 14 against an object to be crushed with a given pressing force until the machine body 11 is raised. In order to raise the machine body 11, it is necessary for the boom-head pressure Ph detected by the pressure sensor 44 to be lower than the automatic hammering authorizing threshold value Px, as well as for the boom-rod pressure Pr detected by the pressure sensor 45 to be higher than the automatic hammering authorizing threshold value Py.

Throughout the period when the hammer device 15 of the hydraulic breaker 14 is pressed against the object to be crushed with the given pressing force by the boom-head pressure Ph and the boom-rod pressure Pr so that the machine body 11 is in the raised state, the RS flip-flop 75 outputs a signal commanding to "maintain the previous state." Should the boom-head pressure Ph exceed the automatic hammering inhibiting threshold value Px+Δx or the boom-rod pressure Pr become lower than the automatic hammering inhibiting threshold value Py−Δy, the RS flip-flop 75 halts automatic hammering operation. Reactivation of automatic hammering requires temporary halting of boom-down operation and subsequent restarting of boom-down operation.

Should automatic hammering be halted due to a reduction of the load to raise the machine body 11 and the boom-head pressure Ph and the boom-rod pressure Pr being no longer in the given range of pressing force in cases where the reset inhibiting flag of the switching device 69 is invalid, a reset operation performed by returning the operation lever 24 being operated to lower the boom 13*bm* to the neutral position first and subsequently operating the operation lever 24 again in such a direction as to lower the boom 13 *bm* is required. However, if automatic hammering is halted due to a reduction of the load to raise the machine body 11 in cases where the reset inhibiting flag of the switching device 69 is effective, the automatic hammering operation can be resumed without the reset operation performed by returning the operation lever 24 to the neutral position first and subsequently operating the operation lever 24 again in such a direction as to lower the boom 13*bm*, provided that the load to raise the machine body 11 again reaches a sufficient level and the boom-head pressure Ph and the boom-rod pressure Pr recovers to the given range of the pressing force. A benefit of this lies in that the step for halting the boom-down operation can be eliminated.

Figure 6:
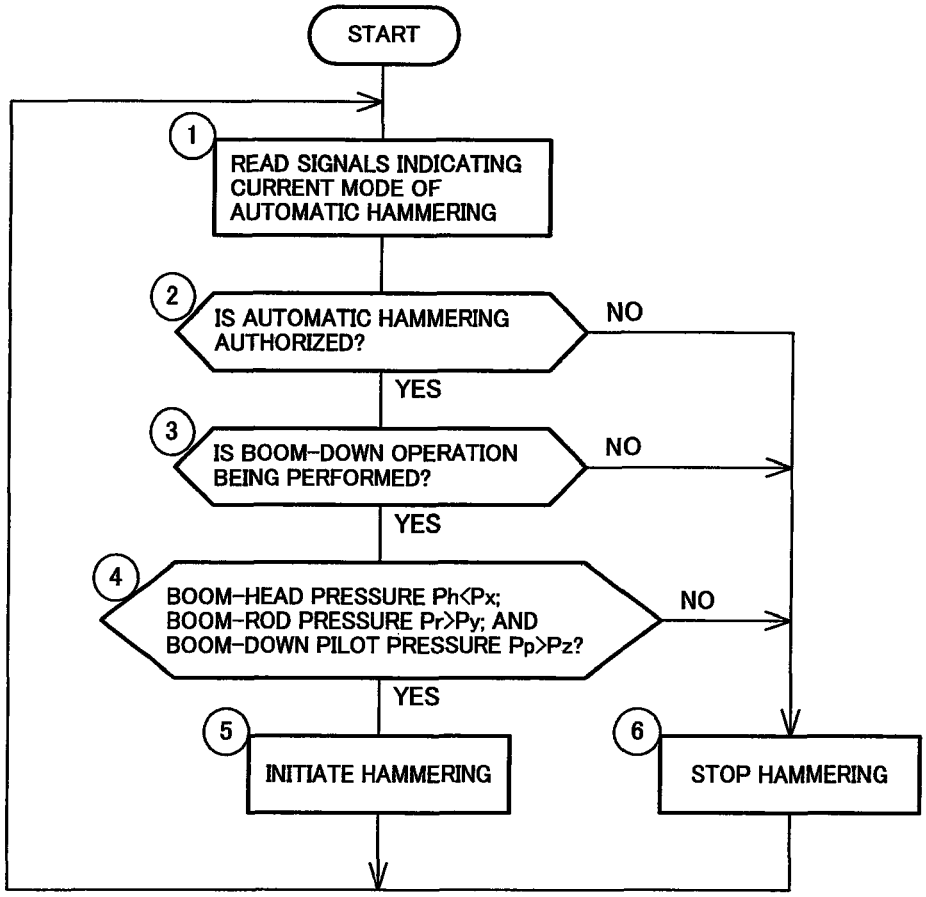
FIG. 6 is a flow chart showing a control procedure of the control circuit.

Next, a control procedure for automatic hammering is explained hereunder, referring to the flow chart illustrated in FIG. 6, wherein numerals enclosed with circles represent step numbers showing the control procedure.

(Step 1)

The controller 51 reads signals indicating what mode the automatic hammering currently is in, i.e. the inhibiting mode, standby mode, or authorizing mode, as illustrated in FIG. 5.

(Step 2)

The controller 51 ascertains whether or not the automatic hammering status is in the automatic hammering authorizing mode. If automatic hammering is in the automatic hammering authorizing mode, the process proceeds to Step 3.

(Step 3)

By means of the pressure sensor 47, which is detecting the boom-down pilot pressure, the controller 51 ascertains whether or not the operation lever 24 has been operated in the boom-down direction. If the controller 51 ascertains that the operation lever 24 has been operated in the boom-down direction, the process proceeds to Step 4.

(Step 4)

Through the pressure sensors 44,45,47, the controller 51 monitors the boom-head pressure Ph and boom-rod pressure Pr of the boom cylinders 12*bm*, as well as the boom-down pilot pressure Pp, in order to detect whether or not the head pressure Ph is lower than the automatic hammering authorizing threshold value Px; the rod pressure Pr is higher than the automatic hammering authorizing threshold value Py; and that the boom-down pilot pressure Pp is higher than the automatic hammering authorizing threshold value Pz. When all of these pressure conditions are satisfied, the process proceeds to Step 5.

(Step 5)

When all of the pressure conditions are satisfied in Step 4, the controller 51 judges that the machine body 11 is in the raised state in which a sufficient load is being applied to the distal end of the hammer. As a result, the controller 51 automatically activates striking by controlling the solenoid-operated directional control valves 52,53 to open the tool attachment controlling first and second spools 33,34, thereby feeding the hydraulic oil to the hammer device 15 (Initiate hammering).

(Step 6)

If it is ascertained in Step 2 that automatic hammering authorizing mode is not in the automatic hammering authorizing mode; or if the operation lever 24 has not been operated in the boom-down direction, such as when the operation lever 24 has been returned to the neutral position; or if the controller detects through the pressure sensors 44,45,47 that the load on the end of the hammer has been reduced, then the controller 51 controls the solenoid-operated directional control valves 52,53 to shut the tool attachment controlling first and second spools 33,34, thereby automatically terminating hammering (Stop hammering).

With the configuration as above, the operator is able to carry out striking only by shifting the operation lever 24 in the boom-down direction.

Figure 7:
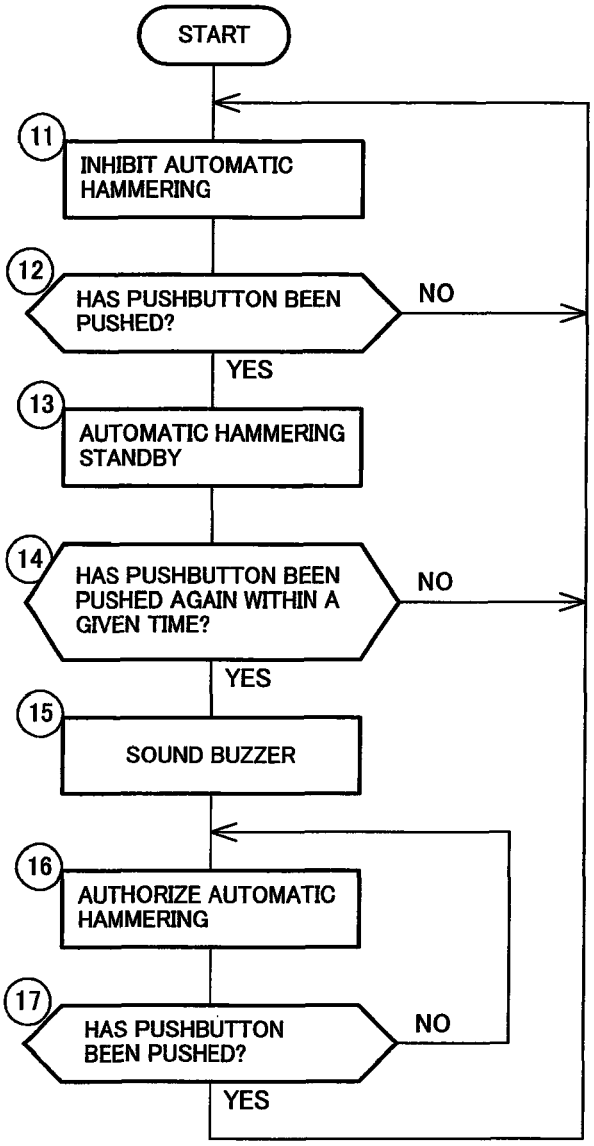
FIG. 7 is a flow chart showing a switching procedure of the control circuit for switching the automatic hammering modes.

Next, FIG. 7 is a flow chart showing the switching procedure of switching the automatic hammering modes illustrated in FIG. 5. The automatic hammering inhibiting mode serves as the default mode (Step 11). As a result of one of the switches 25,26,27, which are pushbuttons or another type of switch, while in the automatic hammering inhibiting mode (YES in Step 12), the controller 51 is put into the automatic hammering standby mode (Step 13).

As a result of one of the switches 25,26,27, which are pushbuttons or another type of switch, again within the given period of time after the start of the automatic hammering standby mode (YES in Step 14), a buzzer that may be provided at the monitor 30 or at any other appropriate location is sounded (Step 15), and thereafter the controller 51 is put into the automatic hammering authorizing mode (Step 16).

As a result of one of the switches 25,26,27, which are pushbuttons or another type of switch, while in the automatic hammering authorizing mode (YES in Step 17), the controller 51 returns to the automatic hammering inhibiting mode described in Step 11. Also in cases where none of the switches 25,26,27, which are pushbuttons or another type of switch, are turned on again within the given period of time in Step 14 (NO in Step 14), the controller 51 returns to the automatic hammering inhibiting mode.

Next, how the logic circuit illustrated in FIG. 2 functions is explained hereunder, referring to FIGS. 8 to 11.

Figure 8:
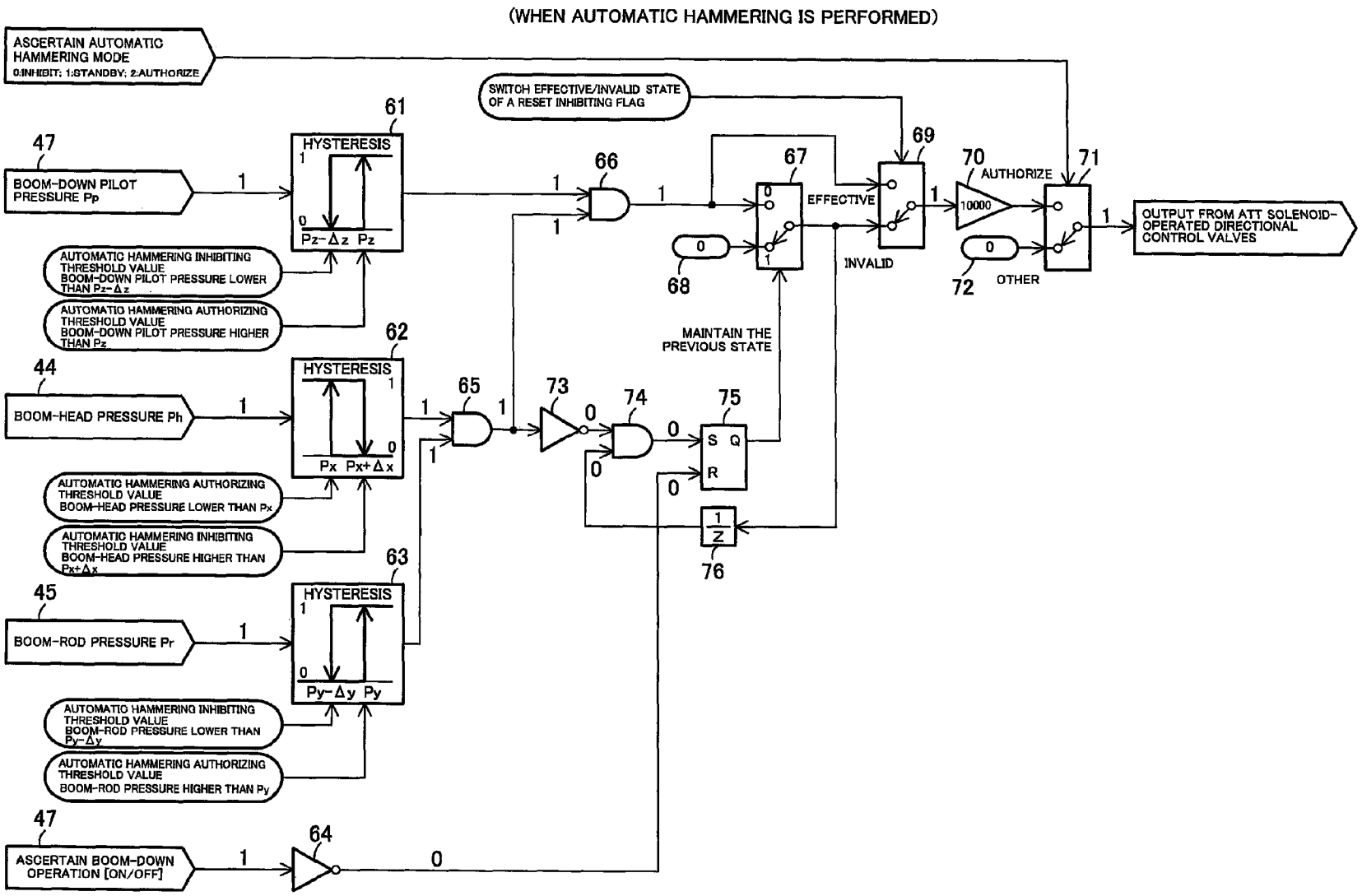
FIG. 8 is a logic circuit diagram showing the state of the control circuit when automatic hammering is being performed.

FIG. 8 illustrates the state when automatic hammering is being performed. The boom-rod pressure Pr of the boom cylinders 12*bm* is used to detect that the machine body 11 is in the raised state. As the boom-head pressure Ph decreases when the machine body 11 is raised, the boom-head pressure Ph, too, is constantly monitored. When the three pressure conditions are satisfied, i.e. the boom-down pilot pressure Pp is higher than the threshold value Pz, the boom-rod pressure Pr is higher than the threshold value Py, and the boom-head pressure Ph is lower than the threshold value Px, "1" is output from the switching device 71 to the solenoid-operated directional control valves 52,53 so that the hydraulic oil is automatically fed to the hydraulic breaker 14, thereby initiating hammering.

Figure 9:
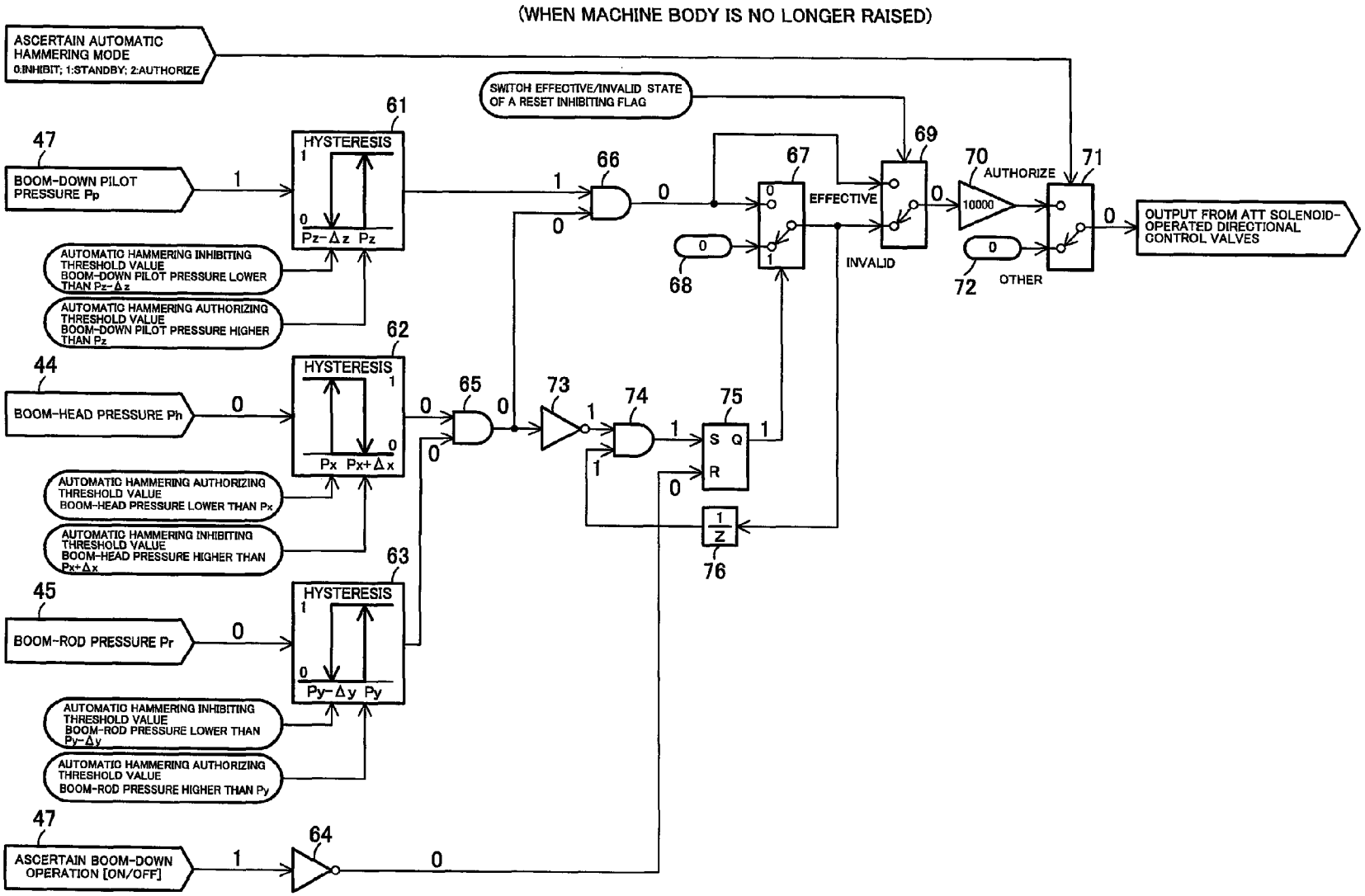
FIG. 9 is a logic circuit diagram showing the state of the control circuit when the machine body is no longer raised.

FIG. 9 illustrates the state when the machine body 11 is no longer raised. Even during a boom-down operation, should the machine body 11 no longer be in the raised state, "1" is input into the set signal input section S of the RS flip-flop 75, and "1" is output to the switching device 67 so that the switching device 67 is switched to the "1" position. As a result, "0" is input from the 0 input section 68, and this signal is input to the switching device 71 through the switching device 69, of which the reset inhibiting flag is in the "invalid" state, as well as the buffer 70. Therefore, even if the status of authorization of automatic hammering indicated in FIG. 7 is ascertained to be "authorized," "0" is output from the switching device 71 to the solenoid-operated directional control valves 52,53 so that the hydraulic breaker 14 stops hammering.

Figure 10:
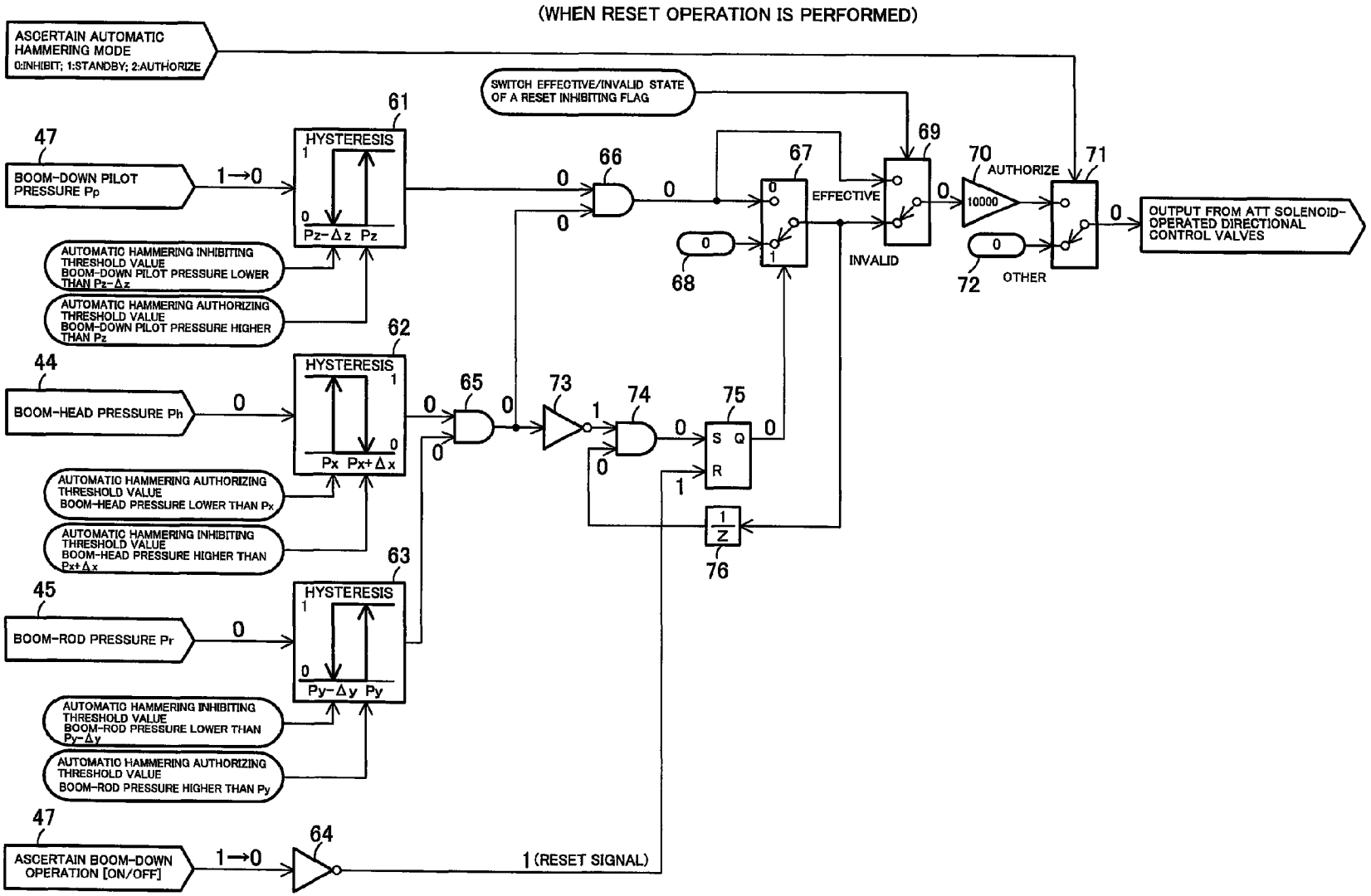
FIG. 10 is a logic circuit diagram showing the state of the control circuit when a reset operation is performed.

FIG. 10 illustrates the state when a reset operation is performed. After the hydraulic breaker 14 is temporarily stopped, the state shown in FIG. 9 is simply maintained until a reset signal is input into the RS flip-flop 75, regardless of whether the three pressure conditions alone are restored. Therefore, in order to resume operation of the hydraulic breaker 14, it is necessary to temporarily cancel the boom-down operation and input a reset signal "1" to the reset signal input section R of the RS flip-flop 75.

Figure 11:
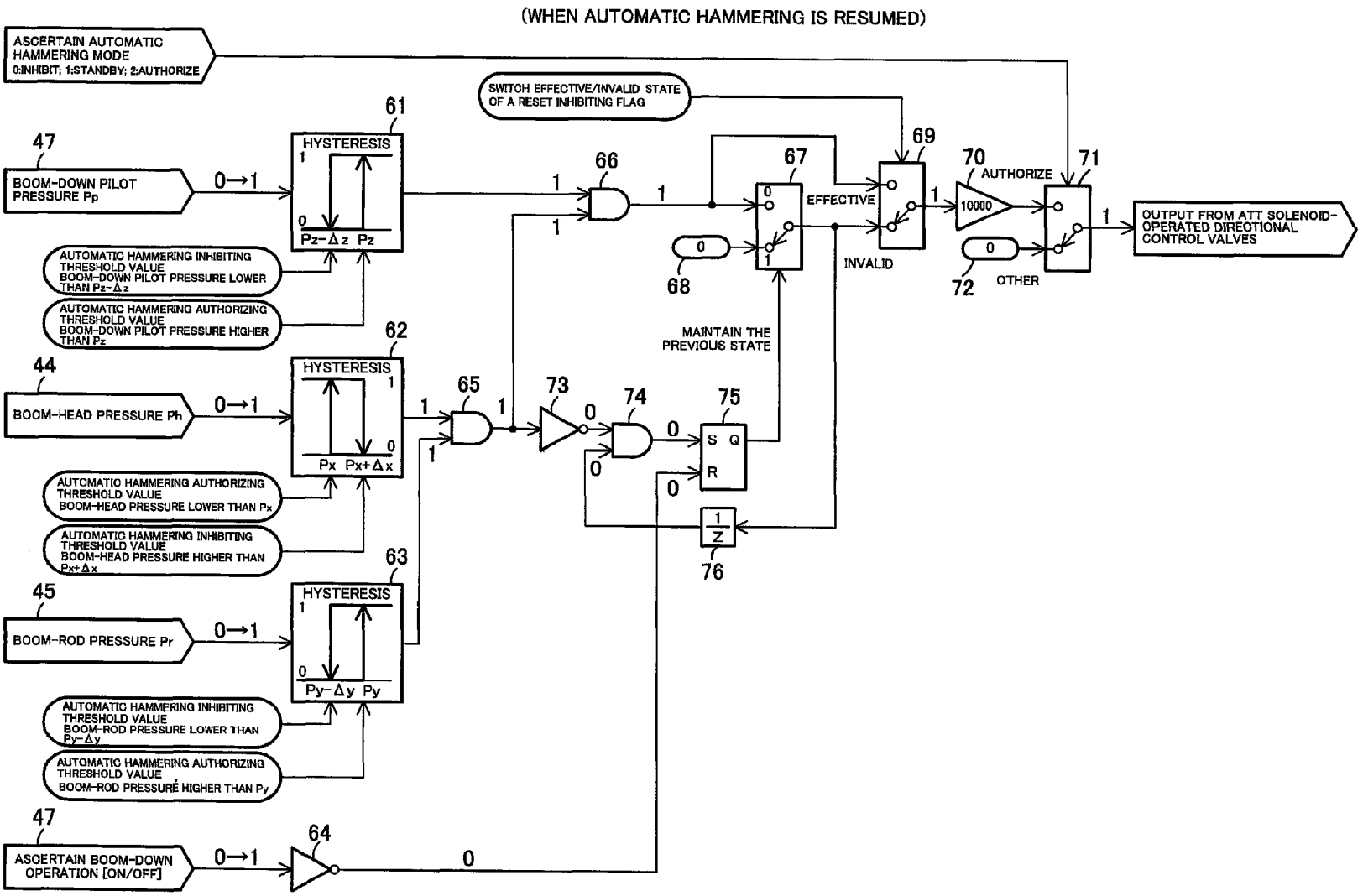
FIG. 11 is a logic circuit diagram showing the state of the control circuit when the automatic hammering is resumed.

FIG. 11 illustrates the state when the automatic hammering is resumed. In the same manner as the state illustrated in FIG. 8, when the three pressure conditions are satisfied, "1" is output from the switching device 71 to the solenoid-operated directional control valves 52,53 so that the hydraulic breaker 14 is automatically reactivated.

Next, effects of the examples illustrated in the drawings are explained.

The controller 51 controls the tool attachment controlling first and second spools 33,34, which serve to control the attachment tool of the hydraulic breaker 14, so that these spools 33,34 open only when the boom-head pressure Ph and the boom-rod pressure Pr of the boom cylinders 12*bm* respectively detected by the pressure sensors 44,45 are in the given range of pressing force while the boom cylinders 12*bm* are operating the work equipment 13 downward, provided that the controller 51 is in the automatic hammering authorizing mode as a result of switching operation of one of the switches 25 to 28. Therefore, after the controller 51 is switched to the automatic hammering authorizing mode by means of one of the switches 25 to 28, in order to activate automatic operation of the hydraulic breaker 14 while ensuring a sufficient level of pressing force to raise the machine body 11, the operator is required only to operate the operation lever 24 in the boom-down direction and does not need to operate any switch to operate or stop the hydraulic breaker 14. In other words, the present invention described above provides an automatic hammering function that is not only simple to operate but also capable of preventing damage to the hammer that would otherwise be caused by blank firing.

To summarize, the invention simplifies hammering operation in that the operator is able to carry out striking simply by operating the operation lever 24 in the boom-down direction. As striking is automatically halted when the load applied to the distal end of the hammer is reduced to a certain level, blank firing is prevented, resulting in prevention of a damage to the hammer. This feature is particularly beneficial in that operation can be more easily conducted, because there is no need for the operator to pay attention to prevent blank firing.

Turning on one of the switches 25 to 28 twice in the given period of time sets the controller 51 to the automatic hammering authorizing mode. Should the given period of time has elapsed after one of the switches 25 to 28 is turned on only once, the controller 51 automatically returns to the automatic hammering inhibiting mode. Therefore, erroneous activation by inadvertently operating one of the switches 25 to 28 once can be prevented.

The automatic hammering inhibiting mode serves as the default mode, and the monitor 30 displays at least that the work machine is in the automatic hammering authorizing mode, in which operation of the hydraulic breaker 14 is permitted. When automatic hammering is activated, a warning is displayed on the monitor 30 as illustrated in FIG. 5. Therefore, an undesired striking due to an inadvertent operation by the operator is prevented.

Turning on one of the switches 25 to 28 while in the automatic hammering authorizing mode sets the controller 51 to the automatic hammering inhibiting mode. Therefore, when raising the machine body 11 to change the direction or for other reasons, the automatic hammering mode can easily be switched to the automatic hammering inhibiting mode.

When the hydraulic breaker 14 is no longer exposed to the given level of pushing force, reactivation of the hydraulic breaker 14 requires a reset operation; in other words canceling the boom-down operation by such an operation as temporarily returning the operation lever 24 of the work equipment 13 to the neutral position and subsequently operating the operation lever 24 again in the boom-down direction. Therefore, the hydraulic breaker 14 is prevented from performing any striking that is not anticipated by the operator.

Although the present invention is suitable for a hydraulic excavator type work machine equipped with a hydraulic breaker, it is also applicable to other work machines, such as a wheel-type work machine, provided that the work machine has a work equipment projecting from the machine body.

The invention claimed is:

1. A work machine comprising:

a machine body;

a work equipment mounted on the machine body;

a hydraulic breaker attached to a distal end of the work equipment;

a control valve configured to control hydraulic oil fed to the hydraulic breaker;

a single rod type hydraulic cylinder configured to operate the work equipment downward so that the hydraulic breaker is pressed against an object to be crushed;

an operation unit configured to operate the hydraulic cylinder in a contracting direction so that the work equipment is operated downward;

pressure sensors respectively configured to detect pressure at the head side and pressure at the rod side of the hydraulic cylinder so as to detect pressing force of the hydraulic breaker;

a changeover switch configured to switch the hydraulic breaker between an automatic hammering inhibiting mode, in which operation of the hydraulic breaker is inhibited, and an automatic hammering authorizing mode, in which the hydraulic breaker is automatically operated in a given range of pressing force; and a controller comprising:

a condition ascertaining unit configured to output a signal for ascertaining whether the pressures of the hydraulic breaker are in the given range of pressing force based on the pressure at the head side and the pressure at the rod side respectively detected by the pressure sensors;

a first switching device configured to receive a signal based on an output signal of the condition ascertaining unit and a 0 signal, and output one of the received signals based on the output signal of the condition ascertaining unit and a signal for ascertaining whether the operation unit has been operated; and a second switching device configured to receive an output signal of the first switching device through a buffer and a 0 signal, and based on an output signal of the changeover switch indicating whether the hydraulic breaker is in the automatic hammering inhibiting mode or the automatic hammering authorizing mode, output one of the received signals as a control signal of the control valve for the hydraulic breaker, wherein the first switching device is configured to output the signal based on the output signal of the condition ascertaining unit when the output signal of the condition ascertaining unit indicates that the pressures of the hydraulic breaker are in the given range of pressing force and the signal for ascertaining whether the operation unit ha been operated indicates that the operation unit has been operated, and otherwise output the 0 signal; and the second switching device is configured to output the 0 signal when the hydraulic breaker is in the automatic hammering inhibiting mode and output the output signal of the first switching device through the buffer when the hydraulic breaker is in the automatic hammering authorizing mode.

2. The work machine as claimed in claim 1, wherein:

the controller has such a function that the controller returns to the automatic hammering inhibiting mode should the changeover switch be turned on once and left without further operation for a given period of time thereafter and that the controller is set to the automatic hammering authorizing mode should the changeover switch be turned on again within the given period of time.

3. The work machine as claimed in claim 1, wherein:

the work machine includes a monitor configured to display at least that the work machine is in the automatic hammering authorizing mode.

4. The work machine as claimed in claim 1, wherein:

the controller is configured to be set to the automatic hammering inhibiting mode, should the changeover switch be turned on while in the automatic hammering authorizing mode.

5. The work machine as claimed in claim 1, wherein:

the controller has such a function that, when pressure at the head side and pressure at the rod side of the hydraulic cylinder become less than the given range of pressing force from the given range of pressing force, reactivation of the hydraulic breaker requires a reset operation performed by returning the operation unit, which is configured to operate the work equipment downward, to a neutral position first and subsequently operating the operation unit again in such a direction as to lower the work equipment.

6. The work machine as claimed in claim 1, wherein:

the controller has a switching device that switches between a function that, when the pressure at the head side and the pressure at the rod side of the hydraulic cylinder become less than the given range of pressing force from the given range of pressing force, reactivation of the hydraulic breaker requires a reset operation performed by returning the operation unit, which is configured to operate the work equipment downward, to a neutral position first and subsequently operating the operation unit again in such a direction as to lower the work equipment, and a function that, after the pressure at the head side and the pressure at the rod side of the hydraulic cylinder become less than the given range of pressing force from the given range of pressing force, reactivation of the hydraulic breaker requires recovering the pressure at the head side and the pressure at the rod side of the hydraulic cylinder to the given range of pressing force without the aforementioned reset operation.

* * * * *